US009761173B2

(12) United States Patent
Han

(10) Patent No.: US 9,761,173 B2
(45) Date of Patent: Sep. 12, 2017

(54) AMOLED PIXEL DRIVING CIRCUIT AND PIXEL DRIVING METHOD

(71) Applicant: Shenzhen China Star Optoelectronics Technology Co., Ltd., Shenzhen (CN)

(72) Inventor: Baixiang Han, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 14/655,726

(22) PCT Filed: Apr. 1, 2015

(86) PCT No.: PCT/CN2015/075682
§ 371 (c)(1),
(2) Date: Jun. 26, 2016

(87) PCT Pub. No.: WO2016/119304
PCT Pub. Date: Aug. 4, 2016

(65) Prior Publication Data

US 2016/0307500 A1 Oct. 20, 2016

(30) Foreign Application Priority Data

Jan. 26, 2015 (CN) ..... 2015 1 0039517

(51) Int. Cl.
*G09G 3/30* (2006.01)
*G09G 3/3233* (2016.01)

(52) U.S. Cl.
CPC ... *G09G 3/3233* (2013.01); *G09G 2300/0819* (2013.01); *G09G 2300/0852* (2013.01);
(Continued)

(58) Field of Classification Search
CPC ..... G09G 3/30; G09G 3/32; G09G 3/3208; G09G 3/3216; G09G 3/3225; G09G 3/3233; G09G 3/3241
(Continued)

(56) References Cited

U.S. PATENT DOCUMENTS

2010/0177125 A1* 7/2010 Miwa ..... G09G 3/3233 345/690
2014/0139411 A1* 5/2014 Jinta ..... G09G 3/3233 345/80

(Continued)

FOREIGN PATENT DOCUMENTS

CN 103165080 A 6/2013

*Primary Examiner* — Amare Mengistu
*Assistant Examiner* — Nelson Lam
(74) *Attorney, Agent, or Firm* — Leong C. Lei

(57) ABSTRACT

The present invention provides an AMOLED pixel driving circuit and a pixel driving method. The AMOLED pixel driving circuit utilizes a 6T2C structure, comprising a first, a second, a third, a fourth, a fifth and a sixth thin film transistors (T1, T2, T3, T4, T5, T6), a first, a second capacitors (C1, C2) and an organic light emitting diode (OLED), and the first thin film transistor (T1) is a drive thin film transistor, and the fifth thin film transistor (T5) is a switch thin film transistor, and the first capacitor (C1) is a coupling capacitor, and the second capacitor (C2) is a storage capacitor; and a first control signal (G1), a second control signal (G2) and a third control signal (G3) are involved, and the three are combined with one another and correspond to a data signal writing stage (1), a whole compensation stage (2), a discharging stage (3) and a light emitting stage (4) one after another. The threshold voltage changes of the drive thin film transistor and the organic light emitting diode can be effectively compensated to make the display brightness of the AMOLED more even and to raise the display quality.

12 Claims, 9 Drawing Sheets

(52) U.S. Cl.
CPC ..... *G09G 2320/0233* (2013.01); *G09G 2320/043* (2013.01); *G09G 2320/045* (2013.01)

(58) Field of Classification Search
USPC ..... 345/76–83; 315/169.3
See application file for complete search history.

(56) References Cited

U.S. PATENT DOCUMENTS

| | | | | |
|---|---|---|---|---|
| 2015/0268763 | A1* | 9/2015 | Zhou | G06F 3/0412 345/174 |
| 2015/0310806 | A1* | 10/2015 | Hu | G09G 3/3258 345/78 |
| 2016/0063920 | A1* | 3/2016 | Lin | G09G 3/3241 345/212 |
| 2016/0133187 | A1* | 5/2016 | Li | G09G 3/3233 345/690 |
| 2016/0189604 | A1* | 6/2016 | Hu | G09G 3/3225 345/215 |
| 2016/0267837 | A1* | 9/2016 | Wang | G09G 3/2003 |

* cited by examiner

AMOLED PIXEL DRIVING CIRCUIT AND PIXEL DRIVING METHOD

FIELD OF THE INVENTION

The present invention relates to a display technology field, and more particularly to an AMOLED pixel driving circuit and a pixel driving method.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED comprises pixels arranged in array and belongs to active display type, which has high lighting efficiency and is generally utilized for the large scale display devices of high resolution.

The AMOLED is a current driving element. When the electrical current flows through the organic light emitting diode, the organic light emitting diode emits light, and the brightness is determined according to the current flowing through the organic light emitting diode itself. Most of the present Integrated Circuits (IC) only transmits voltage signals. Therefore, the AMOLED pixel driving circuit needs to accomplish the task of converting the voltage signals into the current signals. The traditional AMOLED pixel driving circuit generally is 2T1C, which is a structure comprising two thin film transistors and one capacitor to convert the voltage into the current.

As shown in FIG. 1, which is a 2T1C pixel driving circuit employed for AMOLED, comprising a first thin film transistor T10, a second thin film transistor T20 and a capacitor C. The first thin film transistor T10 is a switch thin film transistor, and the second thin film transistor T20 is a drive thin film transistor, and the capacitor C is a storage capacitor. Specifically, a gate of the first thin film transistor T10 is electrically coupled to a scan signal Scan, and a source is electrically coupled to a data signal Data, and a drain is electrically coupled to a gate of the second thin film transistor T20 and one end of the capacitor C; a source of the second thin film transistor T20 is electrically coupled to a power source positive voltage VDD, and a drain is electrically coupled to an anode of an organic light emitting diode D; a cathode of the organic light emitting diode D is electrically coupled to a power source negative voltage VSS; the one end of the capacitor C is electrically coupled to the drain of the first thin film transistor T10, and the other end is electrically coupled to the source of the second thin film transistor T20. As the AMOLED displays, the scan signal Scan controls the first thin film transistor T10 to be activated, and the data signal Data enters the gate of the second thin film transistor T20 and the capacitor C via the first thin film transistor T10. Then, the first thin film transistor T10 is deactivated. With the storage function of the capacitor C, the gate voltage of the second thin film transistor T20 can remain to hold the data signal voltage to make the second thin film transistor T20 to be in the conducted state to drive the current to enter the organic light emitting diode D via the second thin film transistor T20 and to drive the organic light emitting diode D to emit light.

The 2T1C pixel driving circuit traditionally employed for the AMOLED is highly sensitive to the threshold voltage of the thin film transistor, the channel mobility, the trigger voltage and the quantum efficiency of the organic light emitting diode and the transient of the power supply. The threshold voltage of the second thin film transistor T20, i.e. the drive thin film transistor will drift along with the working times. Thus, it results in that the luminescence of the organic light emitting diode D is unstable; furthermore, the drifts of the second thin film transistors T20, i.e. the drive thin film transistors of respective pixels are different, of which the drift values may be increasing or decreasing to cause the nonuniform luminescence and uneven brightness among the respective pixels. The traditional 2T1C pixel driving circuit without compensation can causes 50% nonuniform brightness or even higher.

One method to solve the nonuniform AMOLED display brightness is to add a compensation circuit to each of the pixels. The compensation means that the compensation has to be implemented to the parameters of the drive thin film transistor, such as threshold voltage or mobility to each of the pixels to make the output current irrelevant with these parameters.

SUMMARY OF THE INVENTION

An objective of the present invention is to provide an AMOLED pixel driving circuit, which can effectively compensate the threshold voltage changes of the drive thin film transistor and the organic light emitting diode to make the display brightness of the AMOLED more even and to raise the display quality.

Another objective of the present invention is to provide an AMOLED pixel driving method, which can effectively compensate the threshold voltage changes of the drive thin film transistor and the organic light emitting diode to make the display brightness of the AMOLED more even and to raise the display quality.

For realizing the aforesaid objectives, the present invention provides an AMOLED pixel driving circuit, comprising: a first thin film transistor, a second thin film transistor, a third thin film transistor, a fourth thin film transistor, a fifth thin film transistor, a sixth thin film transistor, a first capacitor, a second capacitor and an organic light emitting diode; the first thin film transistor is a drive thin film transistor, and the fifth thin film transistor is a switch thin film transistor, and the first capacitor is a coupling capacitor, and the second capacitor is a storage capacitor;

a gate of the fifth thin film transistor is electrically coupled to a scan signal, and a source is electrically coupled to a data signal, and a drain is electrically coupled to a first node;

a gate of the fourth thin film transistor is electrically coupled to a first control signal, and a source is electrically coupled to the first node, and a drain is electrically coupled to a second node;

a gate of the sixth thin film transistor is electrically coupled to a second control signal, and a source is electrically coupled to the second node, and a drain is electrically coupled to one end of the second capacitor and a reference voltage;

a gate of the third thin film transistor is electrically coupled to the first control signal, and a source is electrically coupled to a drain of the second thin film transistor and a drain of the first thin film transistor, and a drain is electrically coupled to a third node;

a gate of the second thin film transistor is electrically coupled to a third control signal, and a source is electrically coupled to a power source positive voltage, and a drain is electrically coupled to the source of the third thin film transistor and a drain of the first thin film transistor;

a gate of the first thin film transistor is electrically coupled to the third node, and the drain is electrically coupled to the drain of the second thin film transistor and the source of the third thin film transistor, and a source is electrically coupled to a fourth node;

one end of the first capacitor is electrically coupled to the second node, and the other end is electrically coupled to the third node;

the one end of the second capacitor is electrically coupled to the drain of the sixth thin film transistor, and the other end is electrically coupled to the first node;

an anode of the organic light emitting diode is electrically coupled to the fourth node, and a cathode is electrically coupled to a power source negative voltage.

All of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

All of the first control signal, the second control signal and the third control signal are provided by an external sequence controller.

The first control signal, the second control signal and the third control signal are combined with one another, and correspond to a data signal writing stage, a whole compensation stage, a discharging stage and a light emitting stage one after another;

in the data signal writing stage, the first control signal is low voltage level, and the second control signal is high voltage level, and the third control signal is high voltage level;

in the whole compensation stage, the first control signal is high voltage level, and the second control signal is low voltage level, and the third control signal is high voltage level;

in the discharging stage, the first control signal is high voltage level, and the second control signal is low voltage level, and the third control signal is low voltage level;

in the light emitting stage, the first control signal is low voltage level, and the second control signal is high voltage level, and the third control signal is high voltage level.

The scan signal is a pulse signal in the data signal writing stage, and is low voltage level in any of the whole compensation stage, the discharging stage and the light emitting stage.

The reference voltage is a constant voltage.

The present invention further provides an AMOLED pixel driving circuit, comprising: a first thin film transistor, a second thin film transistor, a third thin film transistor, a fourth thin film transistor, a fifth thin film transistor, a sixth thin film transistor, a first capacitor, a second capacitor and an organic light emitting diode; the first thin film transistor is a drive thin film transistor, and the fifth thin film transistor is a switch thin film transistor, and the first capacitor is a coupling capacitor, and the second capacitor is a storage capacitor;

a gate of the fifth thin film transistor is electrically coupled to a scan signal, and a source is electrically coupled to a data signal, and a drain is electrically coupled to a first node;

a gate of the fourth thin film transistor is electrically coupled to a first control signal, and a source is electrically coupled to the first node, and a drain is electrically coupled to a second node;

a gate of the sixth thin film transistor is electrically coupled to a second control signal, and a source is electrically coupled to the second node, and a drain is electrically coupled to one end of the second capacitor and a reference voltage;

a gate of the third thin film transistor is electrically coupled to the first control signal, and a source is electrically coupled to a drain of the second thin film transistor and a drain of the first thin film transistor, and a drain is electrically coupled to a third node;

a gate of the second thin film transistor is electrically coupled to a third control signal, and a source is electrically coupled to a power source positive voltage, and a drain is electrically coupled to the source of the third thin film transistor and a drain of the first thin film transistor;

a gate of the first thin film transistor is electrically coupled to the third node, and the drain is electrically coupled to the drain of the second thin film transistor and the source of the third thin film transistor, and a source is electrically coupled to a fourth node;

one end of the first capacitor is electrically coupled to the second node, and the other end is electrically coupled to the third node;

the one end of the second capacitor is electrically coupled to the drain of the sixth thin film transistor, and the other end is electrically coupled to the first node;

an anode of the organic light emitting diode is electrically coupled to the fourth node, and a cathode is electrically coupled to a power source negative voltage;

wherein all of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

wherein all of the first control signal, the second control signal and the third control signal are provided by an external sequence controller;

wherein the first control signal, the second control signal and the third control signal are combined with one another, and correspond to a data signal writing stage, a whole compensation stage, a discharging stage and a light emitting stage one after another;

in the data signal writing stage, the first control signal is low voltage level, and the second control signal is high voltage level, and the third control signal is high voltage level;

in the whole compensation stage, the first control signal is high voltage level, and the second control signal is low voltage level, and the third control signal is high voltage level;

in the discharging stage, the first control signal is high voltage level, and the second control signal is low voltage level, and the third control signal is low voltage level;

in the light emitting stage, the first control signal is low voltage level, and the second control signal is high voltage level, and the third control signal is high voltage level.

The present invention further provides an AMOLED pixel driving method, comprising steps of:

step S1, providing an AMOLED pixel driving circuit;

the AMOLED pixel driving circuit comprises: a first thin film transistor, a second thin film transistor, a third thin film transistor, a fourth thin film transistor, a fifth thin film transistor, a sixth thin film transistor, a first capacitor, a second capacitor and an organic light emitting diode; the first thin film transistor is a drive thin film transistor, and the fifth thin film transistor is a switch thin film transistor, and the first capacitor is a coupling capacitor, and the second capacitor is a storage capacitor;

a gate of the fifth thin film transistor is electrically coupled to a scan signal, and a source is electrically coupled to a data signal, and a drain is electrically coupled to a first node;

a gate of the fourth thin film transistor is electrically coupled to a first control signal, and a source is electrically coupled to the first node, and a drain is electrically coupled to a second node;

a gate of the sixth thin film transistor is electrically coupled to a second control signal, and a source is electrically coupled to the second node, and a drain is electrically coupled to one end of the second capacitor and a reference voltage;

a gate of the third thin film transistor is electrically coupled to the first control signal, and a source is electrically coupled to a drain of the second thin film transistor and a drain of the first thin film transistor, and a drain is electrically coupled to a third node;

a gate of the second thin film transistor is electrically coupled to a third control signal, and a source is electrically coupled to a power source positive voltage, and a drain is electrically coupled to the source of the third thin film transistor and a drain of the first thin film transistor;

a gate of the first thin film transistor is electrically coupled to the third node, and the drain is electrically coupled to the drain of the second thin film transistor and the source of the third thin film transistor, and a source is electrically coupled to a fourth node;

one end of the first capacitor is electrically coupled to the second node, and the other end is electrically coupled to the third node;

the one end of the second capacitor is electrically coupled to the drain of the sixth thin film transistor, and the other end is electrically coupled to the first node;

an anode of the organic light emitting diode is electrically coupled to the fourth node, and a cathode is electrically coupled to a power source negative voltage;

step S2, entering a scan stage;

the first control signal provides low voltage level, and the second control signal provides high voltage level, and the third control signal provides high voltage level, and both the third, the fourth thin film transistors are deactivated; the scan signal is a pulse signal and a line by line scan is implemented, and the data signal is written into the first node line by line and stored in the second capacitor;

step S3, entering a whole compensation stage;

all of the scan signals are low voltage level, and the fifth thin film transistors in all pixels are deactivated; the first control signal provides high voltage level, and the second control signal provides low voltage level, and the third control signal provides high voltage level, and both the third, the fourth thin film transistors are activated, and the sixth thin film transistor is deactivated, and the data signal is written into the second node from the first node, and voltage level of the third node is pulled to be high voltage level by the power source positive voltage;

step S4, entering a discharging stage;

all of the scan signals remain to be low voltage level, and the fifth thin film transistors in all pixels are deactivated; the first control signal provides high voltage level, and the second control signal provides low voltage level, and the third control signal provides low voltage level, and both the second, the sixth thin film transistors are deactivated, and the third node is discharged to:

$$V_G = VSS + V_{th_T1} + V_{th_OLED}$$

wherein $V_G$ represents a voltage of the third node, and $V_{th_T1}$ represents a threshold voltage of the first thin film transistor, and $V_{th_OLED}$ represents a threshold voltage of the organic light emitting diode;

step S5, entering a light emitting stage;

all of the scan signals remain to be low voltage level, and the fifth thin film transistors in all pixels are deactivated; the first control signal provides low voltage level, and the second control signal provides high voltage level, and the third control signal provides high voltage level, and both the second, the sixth thin film transistors are deactivated, and the second node is written with the reference voltage;

the voltage of the third node, i.e. a gate voltage of the first thin film transistor is coupled by the first capacitor to:

$$\text{i } V_G = VSS + V_{th_T1} + V_{th_OLED} + V_{ref} - V_{Data}$$

a voltage of the fourth node, i.e. a source voltage of the first thin film transistor is:

$$V_B = VSS + V_{th_OLED} + f(\text{Data})$$

wherein $V_G$ represents the voltage of the third node, i.e. the gate voltage of the first thin film transistor, and VSS represents the power source negative voltage, and $V_{th_T1}$ represents a threshold voltage of the first thin film transistor, and $V_{th_OLED}$ represents a threshold voltage of the organic light emitting diode, and $V_{ref}$ represents the reference voltage, and $V_{Data}$ represents the data signal voltage, and $V_B$ represents the voltage of the fourth node, i.e. the source voltage of the first thin film transistor, and f(Data) represents a function related to the data signal;

the organic light emitting diode emits light, and a current flowing through the organic light emitting diode is irrelevant with the threshold voltage of the first thin film transistor and the threshold voltage of the organic light emitting diode.

All of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

All of the first control signal, the second control signal and the third control signal are provided by an external sequence controller.

The reference voltage is a constant voltage.

The benefits of the present invention are: the AMOLED pixel driving circuit and the pixel driving method provided by the present invention utilize the 6T2C structure driving circuit to compensate the threshold voltage changes of the drive thin film transistor and the organic light emitting diode in each pixel and the time of the compensation period is adjustable without influencing the light emitting period of the organic light emitting diode, of which the threshold voltage changes of the drive thin film transistor and the organic light emitting diode can be effectively compensated to make the display brightness of the AMOLED more even and to raise the display quality.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
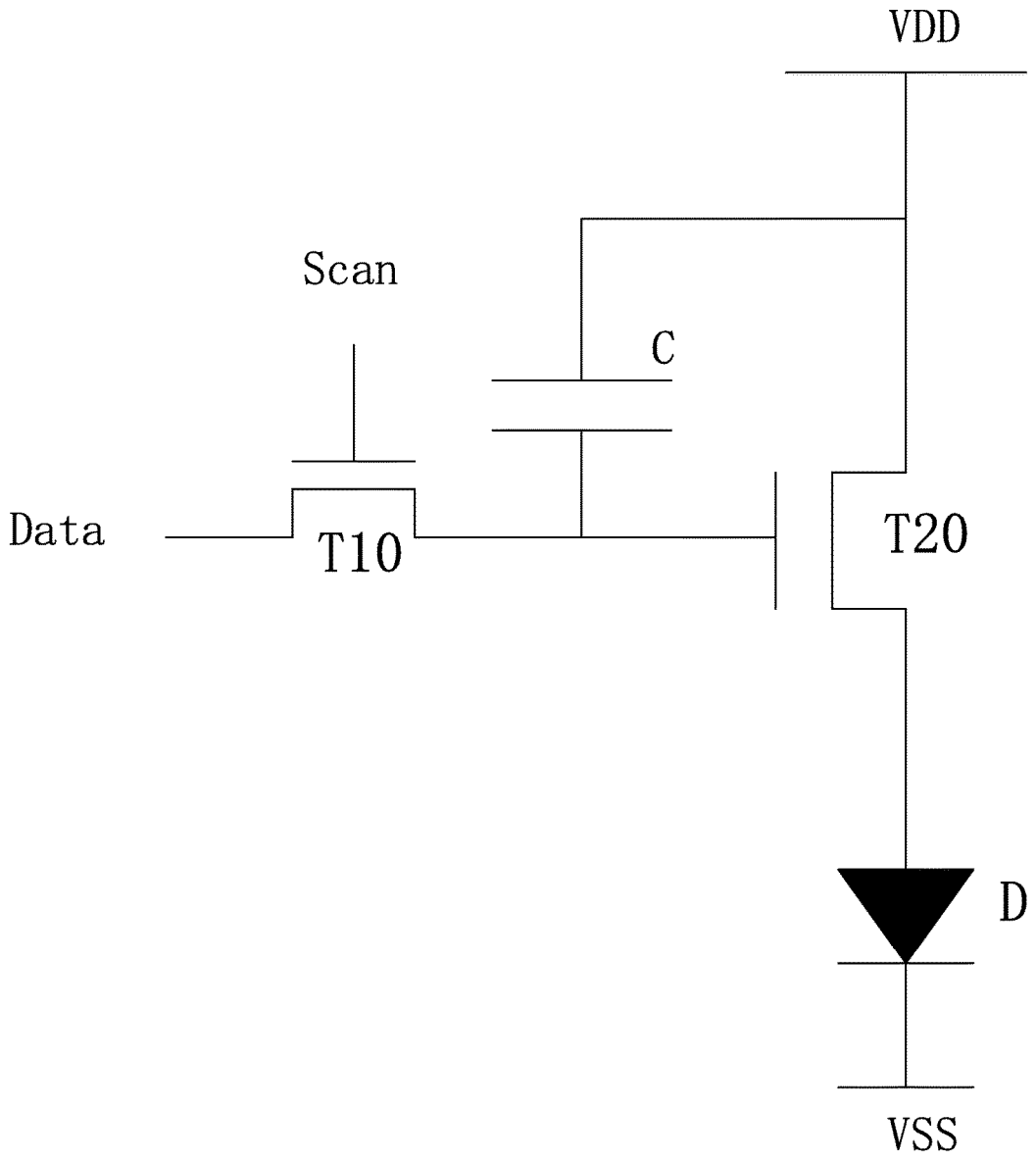
Fig. 1(Prior Art)
FIG. 1 is a circuit diagram of 2T1C pixel driving circuit employed for AMOLED according to prior art.
Figure 2:
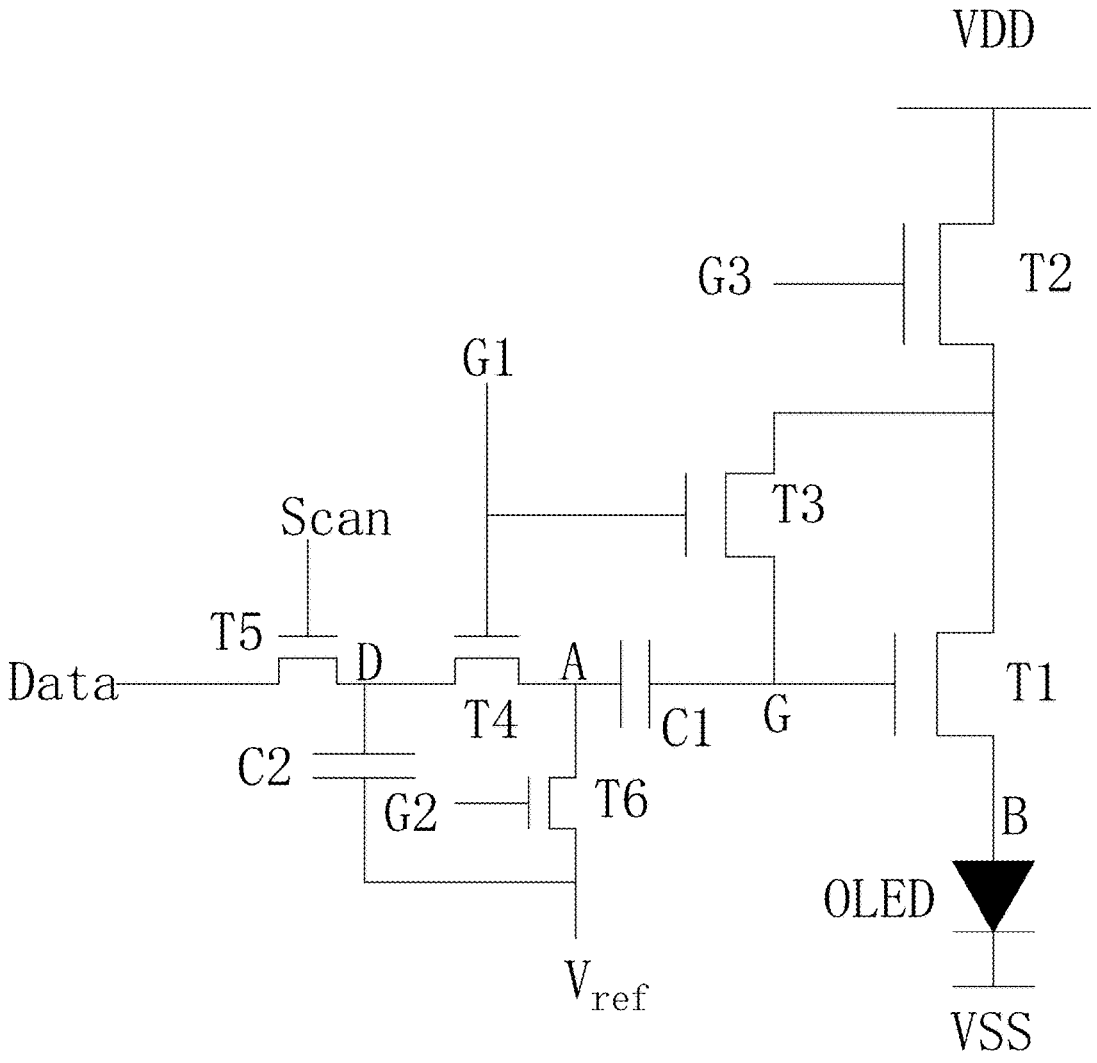
FIG. 2 is a circuit diagram of an AMOLED pixel driving circuit according to present invention.

Please refer to FIG. 2. The present invention provides an AMOLED pixel driving circuit, and the AMOLED pixel driving circuit utilizes a 6T2C structure, and comprises: a first thin film transistor T1, a second thin film transistor T2, a third thin film transistor T3, a fourth thin film transistor T4, a fifth thin film transistor T5, a sixth thin film transistor T6, a first capacitor C1, a second capacitor C2 and an organic light emitting diode OLED.

A gate of the fifth thin film transistor T5 is electrically coupled to a scan signal Scan, and a source is electrically coupled to a data signal Data, and a drain is electrically coupled to a first node D; a gate of the fourth thin film transistor T4 is electrically coupled to a first control signal G1, and a source is electrically coupled to the first node D, and a drain is electrically coupled to a second node A; a gate of the sixth thin film transistor T6 is electrically coupled to a second control signal G2, and a source is electrically coupled to the second node A, and a drain is electrically coupled to one end of the second capacitor C2 and a reference voltage $V_{ref}$; a gate of the third thin film transistor T3 is electrically coupled to the first control signal G1, and a source is electrically coupled to a drain of the second thin film transistor T2 and a drain of the first thin film transistor T1, and a drain is electrically coupled to a third node G; a gate of the second thin film transistor T2 is electrically coupled to a third control signal G3, and a source is electrically coupled to a power source positive voltage VDD, and a drain is electrically coupled to the source of the third thin film transistor T3 and a drain of the first thin film transistor T1; a gate of the first thin film transistor T1 is electrically coupled to the third node G, and the drain is electrically coupled to the drain of the second thin film transistor T2 and the source of the third thin film transistor T3, and a source is electrically coupled to a fourth node B; one end of the first capacitor C1 is electrically coupled to the second node A, and the other end is electrically coupled to the third node G; the one end of the second capacitor C2 is electrically coupled to the drain of the sixth thin film transistor T6, and the other end is electrically coupled to the first node D; an anode of the organic light emitting diode OLED is electrically coupled to the fourth node B, and a cathode is electrically coupled to a power source negative voltage VSS.

The first control signal G1 is employed to control the activations and deactivations of the third, the fourth thin film transistors T3, T4; the second control signal G2 is employed to control the activation and deactivation of the sixth thin film transistors T6; the third control signal G3 is employed to control the activation and deactivation of the second thin film transistors T2; the scan signal Scan is employed to control the activation and deactivation of the fifth thin film transistors T5 to realize the scan line by line; the data signal Data is employed to control the brightness of the organic light emitting diode OLED. The reference voltage $V_{ref}$ is a constant voltage. The first thin film transistor T1 is a drive thin film transistor, and the fifth thin film transistor T5 is a switch thin film transistor, and the first capacitor C1 is a coupling capacitor, and the second capacitor C2 is a storage capacitor.

Specifically, all of the first thin film transistor T1, the second thin film transistor T2, the third thin film transistor T3, the fourth thin film transistor T4, the fifth thin film transistor T5 and the sixth thin film transistor T6 are Low Temperature Poly-silicon thin film transistors, oxide semiconductor thin film transistors or amorphous silicon thin film transistors. All of the first control signal G1, the second control signal G2 and the third control signal G3 are provided by an external sequence controller.

Figure 3:
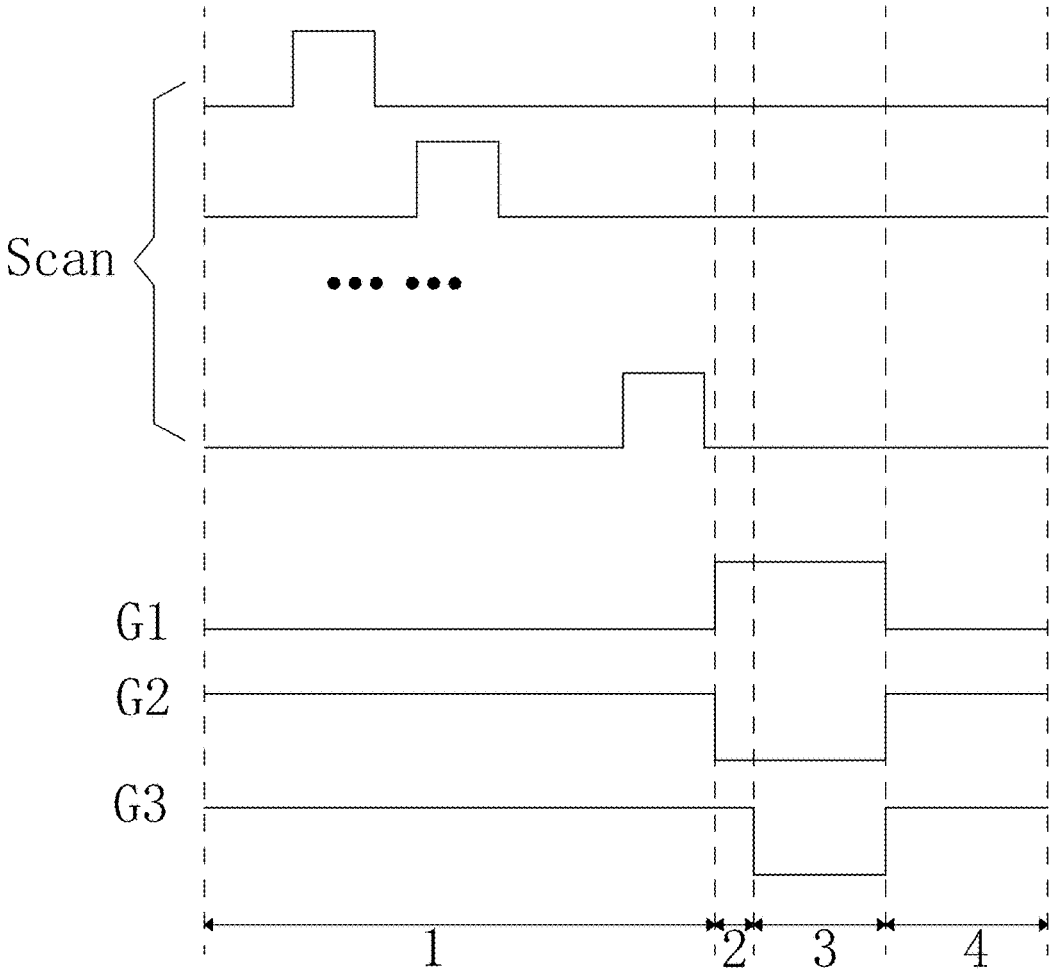
FIG. 3 is a sequence diagram of an AMOLED pixel driving circuit according to present invention.

Furthermore, referring to FIG. 3, the first control signal G1, the second control signal G2 and the third control signal G3 are combined with one another and correspond to a data signal writing stage 1, a whole compensation stage 2, a discharging stage 3 and a light emitting stage 4 one after another. In the data signal writing stage 1, the first control signal G1 is low voltage level, and the second control signal G2 is high voltage level, and the third control signal G3 is high voltage level; in the whole compensation stage 2, the first control signal G1 is high voltage level, and the second control signal G2 is low voltage level, and the third control signal G3 is high voltage level; in the discharging stage 3, the first control signal G1 is high voltage level, and the second control signal G2 is low voltage level, and the third control signal G3 is low voltage level; in the light emitting stage 4, the first control signal G1 is low voltage level, and the second control signal G2 is high voltage level, and the third control signal G3 is high voltage level. The scan signal Scan is a pulse signal in the data signal writing stage 1, and is low voltage level in any of the whole compensation stage 2, the discharging stage 3 and the light emitting stage 4.

In the data signal writing stage 1, a line by line scan is implemented with the scan signal Scan, and the data signal Data is written into the first node D line by line and stored in the second capacitor C2; in the whole compensation stage 2, the data signal Data is written into the second node A from the first node D, and voltage level of the third node G is pulled to be high voltage level by the power source positive voltage VDD; in the discharging stage 3, the third node G is discharged; in the light emitting stage 4, the second node A is written with the reference voltage $V_{ref}$, and the voltage of the third node G, i.e. a gate voltage of the first thin film transistor T1 is coupled by the first capacitor C1, and the organic light emitting diode OLED emits light, and a current flowing through the organic light emitting diode OLED is irrelevant with the threshold voltage of the first thin film transistor T1 and the threshold voltage of the organic light emitting diode OLED.

The AMOLED pixel driving circuit can effectively compensate the threshold voltage changes of the first thin film transistor T1, i.e. the drive thin film transistor and the organic light emitting diode OLED to make the display brightness of the AMOLED more even and to raise the display quality.

Figure 4:
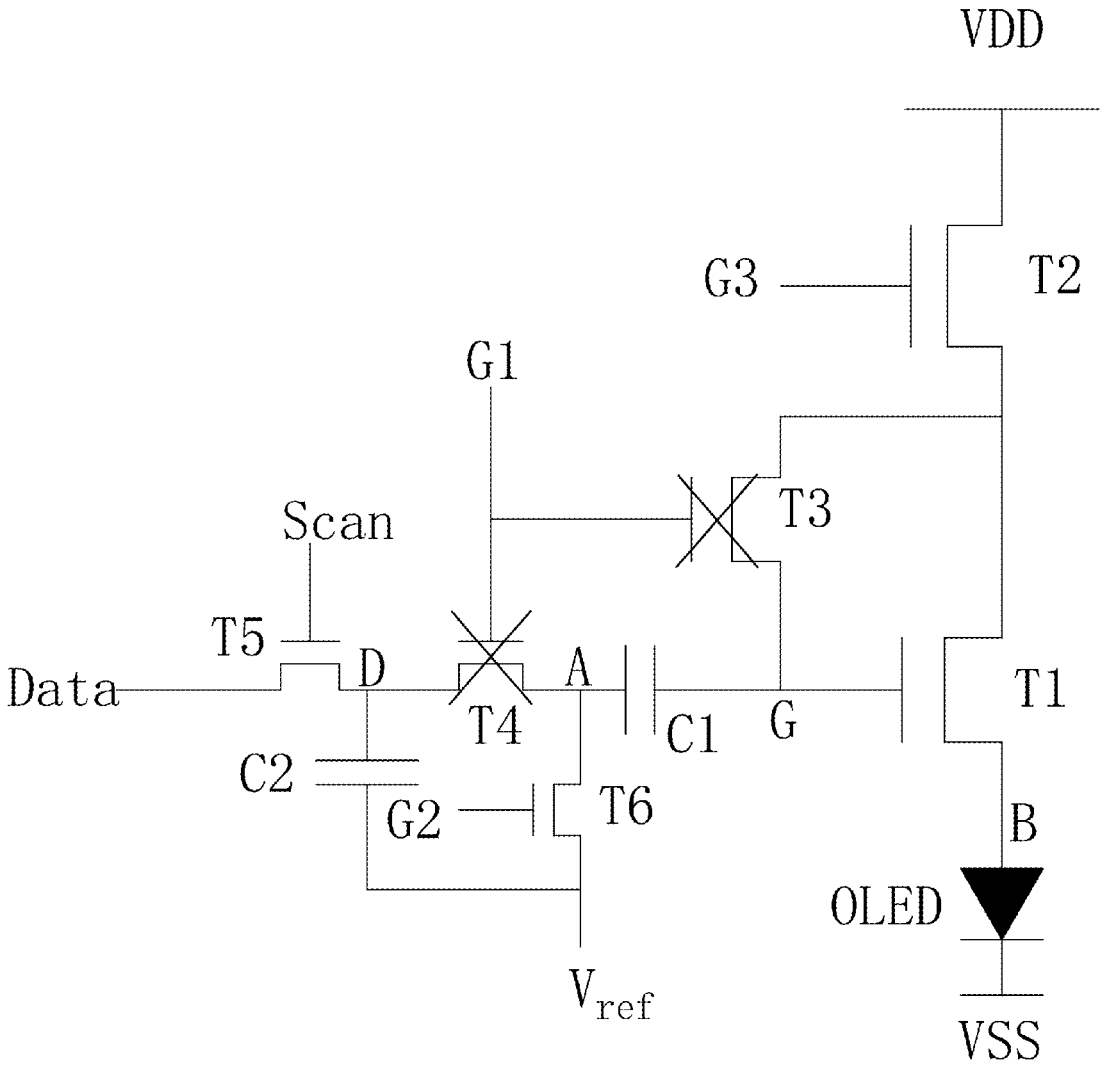
FIG. 4 is a diagram of the step S2 of an AMOLED pixel driving method according to the present invention.

Please refer from FIG. 4 to FIG. 7 in conjunction with FIG. 2 and FIG. 3. On the basis of the aforesaid AMOLED pixel driving circuit, the present invention further provides an AMOLED pixel driving method, comprising steps of:

step S1, providing an AMOLED pixel driving circuit utilizing the 6T2C structure as shown in the aforesaid FIG. 2, and the description of the circuit is not repeated here.

step S2, referring to FIG. 3 and FIG. 4, entering a scan stage 1.

Figure 5:
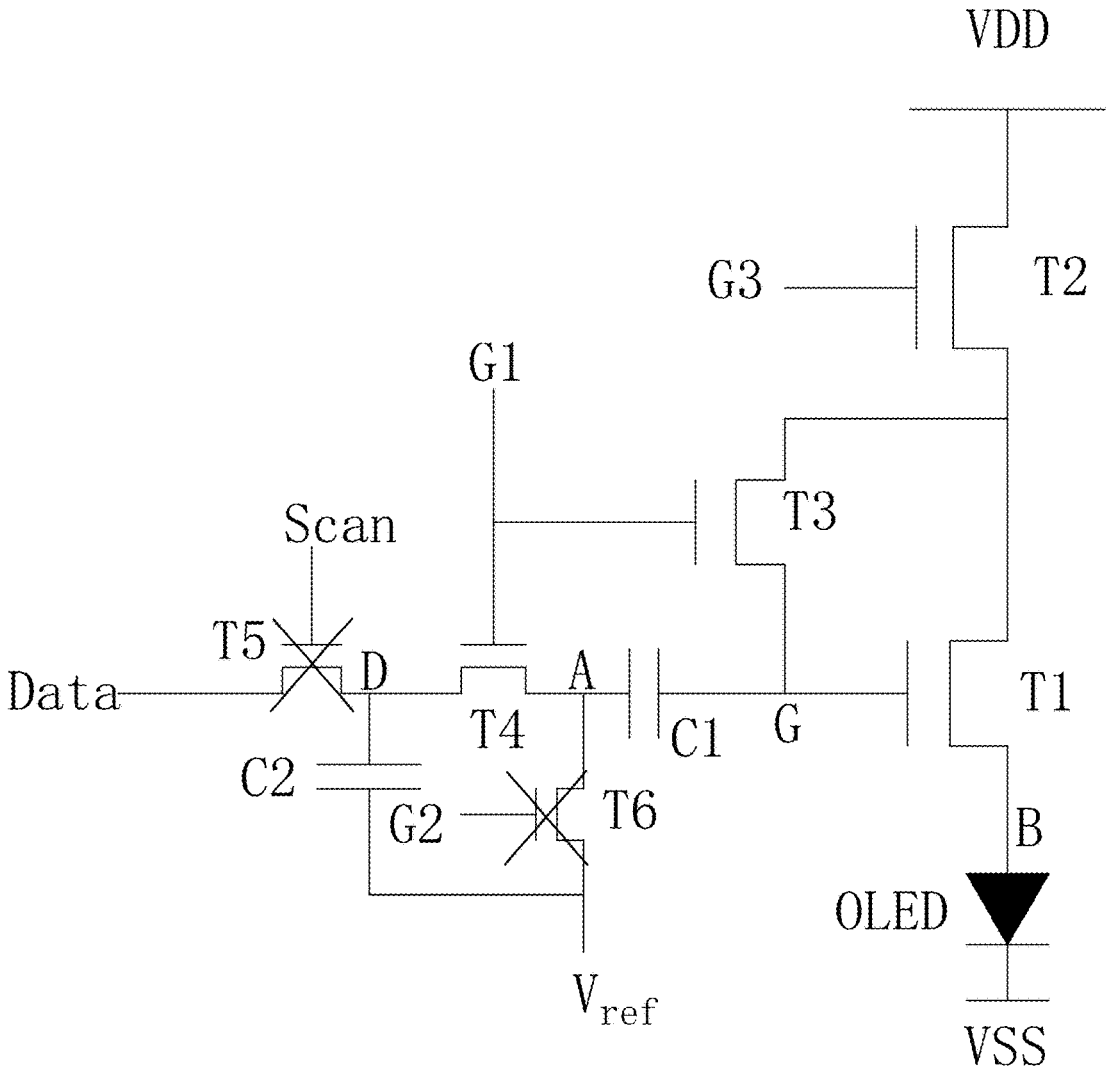
FIG. 5 is a diagram of the step S3 of an AMOLED pixel driving method according to the present invention.

The first control signal G1 provides low voltage level, and the second control signal G2 provides high voltage level, and the third control signal G3 provides high voltage level, and both the third, the fourth thin film transistors T3, T4 are deactivated; the scan signal Scan is a pulse signal and a line by line scan is implemented, and the data signal Data is written into the first node D line by line and stored in the second capacitor C2.

step S3, referring to FIG. 3 and FIG. 5, entering a whole compensation stage 2.

Figure 6:
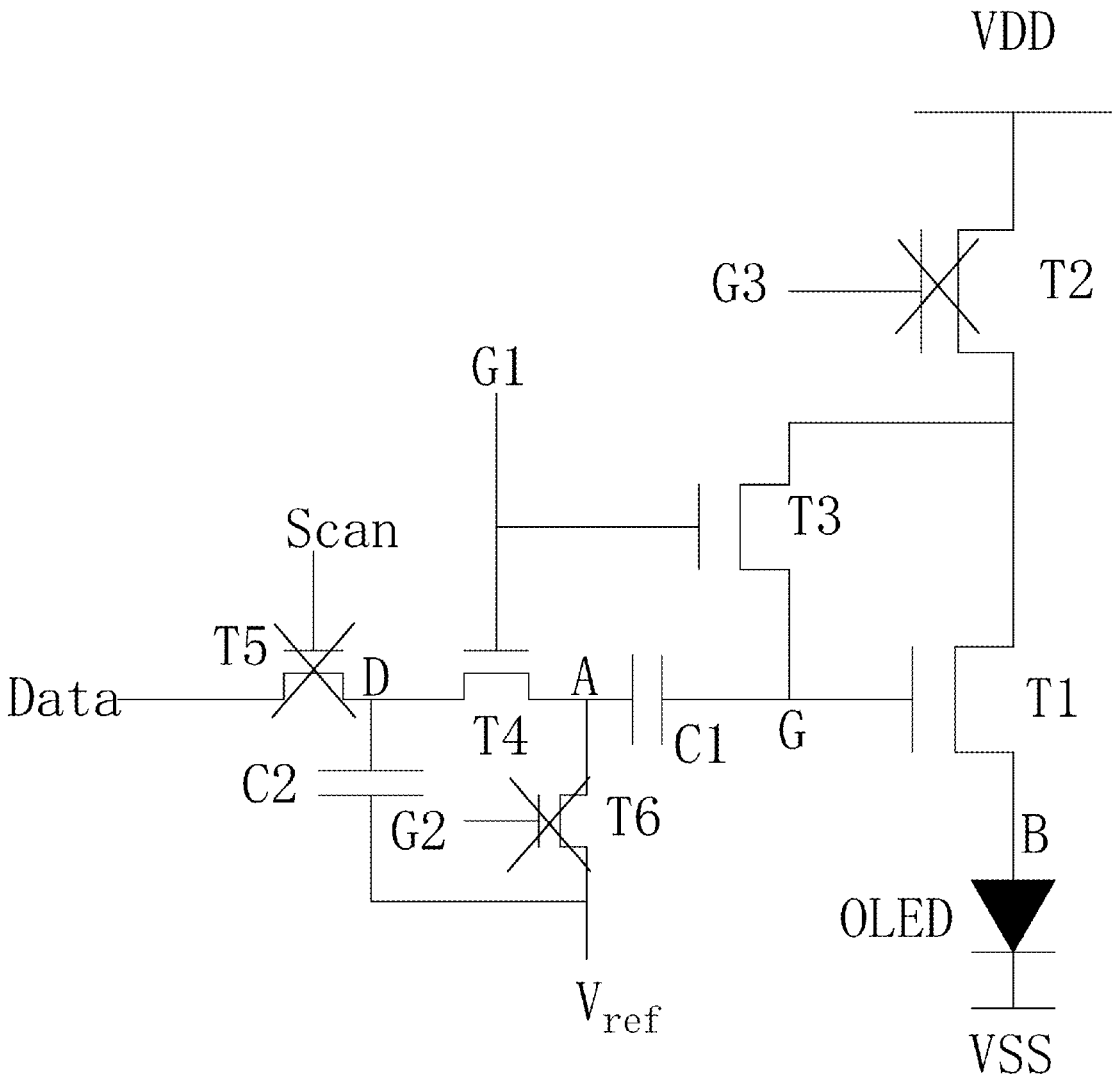
FIG. 6 is a diagram of the step S4 of an AMOLED pixel driving method according to the present invention.

All of the scan signals Scan are low voltage level, and the fifth thin film transistors T5 in all pixels are deactivated; the first control signal G1 provides high voltage level, and the second control signal G2 provides low voltage level, and the third control signal G3 provides high voltage level, and both the third, the fourth thin film transistors T3, T4 are activated, and the sixth thin film transistor T6 is deactivated, and the data signal Data is written into the second node A from the first node D, and voltage level of the third node G is pulled to be high voltage level by the power source positive voltage VDD.

step S4, referring to FIG. 3 and FIG. 6, entering a discharging stage 3.

All of the scan signals Scan remain to be low voltage level, and the fifth thin film transistors T5 in all pixels are deactivated; the first control signal G1 provides high voltage level, and the second control signal G2 provides low voltage level, and the third control signal G3 provides low voltage level, and both the second, the sixth thin film transistors T2, T6 are deactivated.

Figure 7:
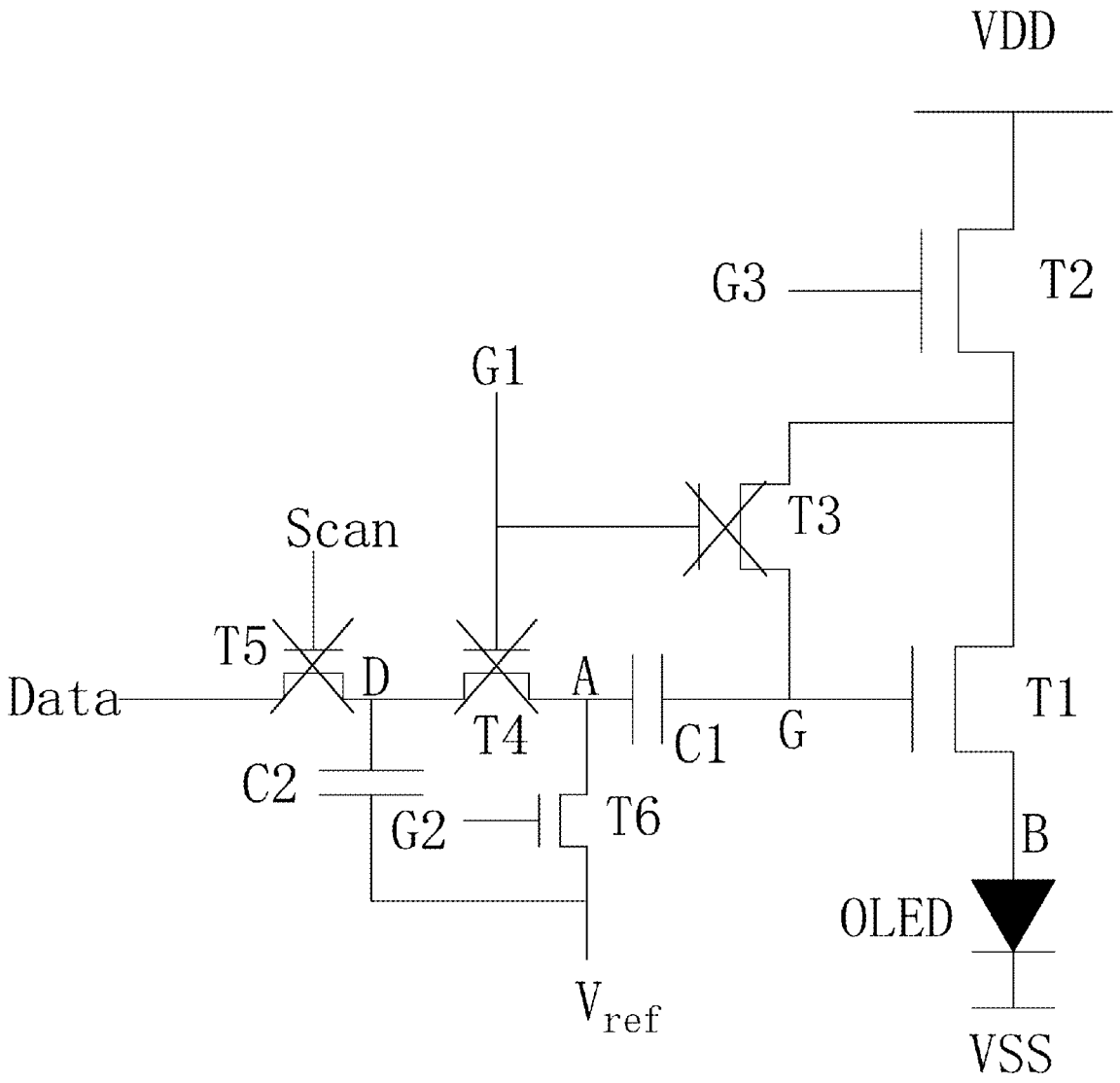
FIG. 7 is a diagram of the step S5 of an AMOLED pixel driving method according to the present invention.

Because the third control signal G3 provides low voltage level, the second thin film transistor T2 is deactivated, and the drain of the first thin film transistor T1 and the power source positive voltage VDD stop to be coupled. At this moment, the first control signal G1 remains to provide high voltage level, and the third thin film transistor T3 is activated, and the gate and the drain of the first thin film transistor T1 are directly coupled via the third thin film transistor T3. That is, the first thin film transistor T1 is short to be a diode. Under such circumstance, the third node G is discharged to:

$V_G$=VSS+$V_{th_T1}$+$V_{th_OLED}$, wherein $V_G$ represents the voltage of the third node G, and VSS represents the power source negative voltage, and $V_{th_T1}$ represents the threshold voltage of the first thin film transistor T1, and $V_{th_OLED}$ represents a threshold voltage of the organic light emitting diode OLED.

step S5, referring to FIG. 3 and FIG. 7, entering a light emitting stage 4.

All of the scan signals Scan remain to be low voltage level, and the fifth thin film transistors T5 in all pixels are deactivated; the first control signal G1 provides low voltage level, and the second control signal G2 provides high voltage level, and the third control signal G3 provides high voltage level, and both the third, the fourth thin film transistors T3, T4 are deactivated, and both the second, the sixth thin film transistors T2, T6 are activated, and the second node A is written with the reference voltage $V_{ref}$, the voltage of the third node G, i.e. a gate voltage of the first thin film transistor T1 is coupled by the first capacitor C1 to:

$$V_G=VSS+V_{th_T1}+V_{th_OLED}+V_{ref}-V_{Data}$$

a voltage of the fourth node B, i.e. a source voltage of the first thin film transistor T1 is:

$$V_B=VSS+V_{th_OLED}+f(\text{Data})$$

wherein $V_G$ represents the voltage of the third node G, i.e. the gate voltage of the first thin film transistor T1, and VSS represents the power source negative voltage, and $V_{th_T1}$ represents a threshold voltage of the first thin film transistor T1, and $V_{th_OLED}$ represents a threshold voltage of the organic light emitting diode OLED, and $V_{ref}$ represents the reference voltage, and $V_{Data}$ represents the data signal voltage, and $V_B$ represents the voltage of the fourth node B, i.e. the source voltage of the first thin film transistor T1, and f(Data) represents a function related to the data signal, which represents the influence generated by a voltage $V_B$ of the data signal Data to the fourth node B, i.e. the source voltage of the first thin film transistor T1. Those of people who are skilled in this field can employ the known function on demands.

The organic light emitting diode OLED emits light.

As known, the formula of calculating the current flowing through the organic light emitting diode OLED is:

$$I=1/2Cox(\mu W/L)(V_{gs}-V_{th})^2 \quad (1)$$

wherein I is the current of the organic light emitting diode OLED, and p is the carrier mobility of drive thin film transistor, and W and L respectively are the width and the length of the channel of the drive thin film transistor, and $V_{gs}$ is the voltage between the gate and the source of the drive thin film transistor, and Vth is the threshold voltage of the drive thin film transistor.

In the present invention, the threshold voltage Vth of the drive thin film transistor, i.e. the threshold voltage $V_{th_T1}$ of the first thin film transistor T1; $V_{gs}$ is the difference between the voltage of the third node G, i.e. the gate voltage of the first thin film transistor T1 and the voltage of the fourth node B, i.e. the source voltage of the first thin film transistor T1, which is:

$$\begin{aligned} V_{gs} &= V_G - V_B \quad (2) \\ &= (VSS + V_{th_T1} + V_{th_OLED} + V_{ref} - V_{Data}) - \\ &\quad (VSS + V_{th_OLED} + f(\text{Data})) \\ &= V_{th_T1} + V_{ref} - V_{Data} - f(D_{ata}) \end{aligned}$$

the equation (2) is substituted into equation (1) to derive:

$$I = 1/2Cox(\mu W/L)(V_{th_T1} + V_{ref} - V_{Data} - f(\text{Data}) - V_{th_T1})^2$$
$$= 1/2Cox(\mu W/L)(V_{ref} - V_{Data} - f(\text{Data}))^2$$

Thus it can be seen, the current I flowing through the organic light emitting diode OLED is irrelevant with the threshold voltage $V_{th_T1}$ of the first thin film transistor T1, the threshold voltage $V_{th_OLED}$ of the organic light emitting diode OLED and the power source negative voltage VSS to realize the compensation function. The threshold voltage changes of the drive thin film transistor, i.e. the first thin film transistor T1 and the organic light emitting diode OLED can be effectively compensated to make the display brightness of the AMOLED more even and to raise the display quality.

Furthermore, the AMOLED pixel driving method possesses the properties below: merely one set of GOA signal is required; the period of the whole compensation stage 2 in the step S3 is adjustable; the light emitting period of the organic light emitting diode is not influenced; the threshold voltage $V_{th_T1}$ of the first thin film transistor T1, the threshold voltage $V_{th_OLED}$ of the organic light emitting diode OLED and the power source negative voltage VSS can be compensated.

Figure 8:
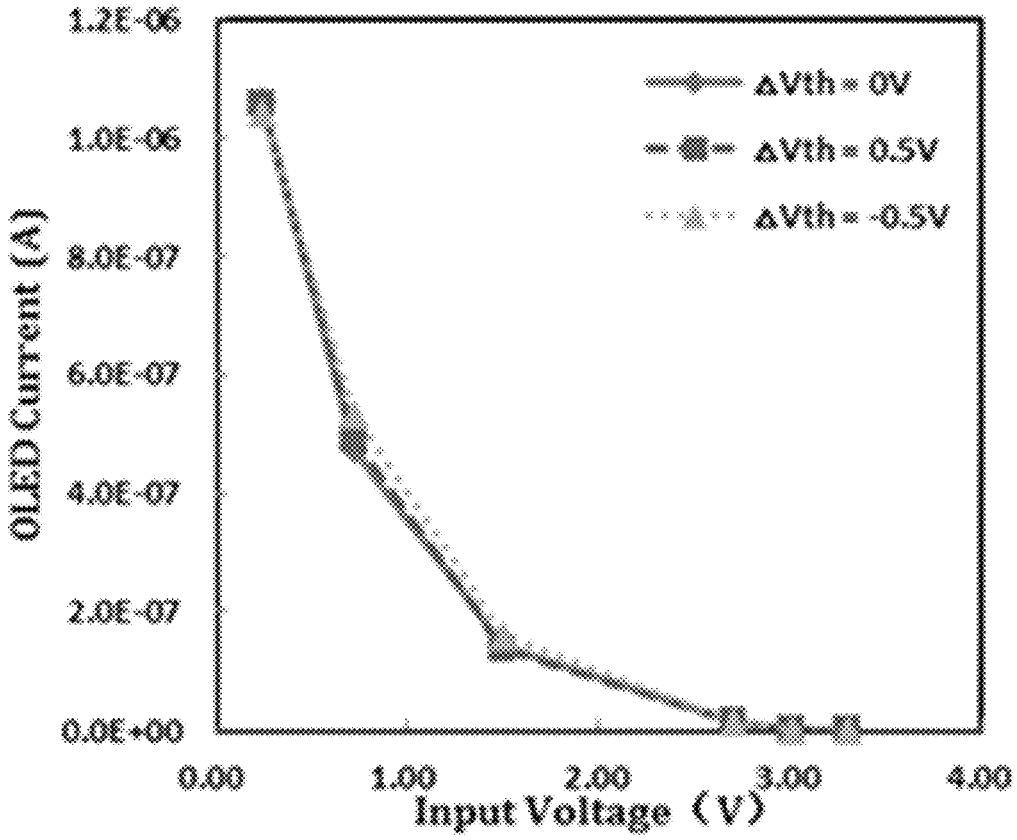
FIG. 8 is a simulation diagram of the corresponding current flowing through the OLED as the threshold voltage of the drive thin film transistor in the present invention drifts.

Please refer to FIG. 8. As the threshold voltage of the drive thin film transistor, i.e. the first thin film transistor T1 respectively drifts 0V, +0.5V, −0.5V, the change of the current flowing through the organic light emitting diode OLED will not exceed 15%, which effectively ensures the light emitting stability of the organic light emitting diode OLED to make the brightness of the AMOLED more even.

Figure 9:
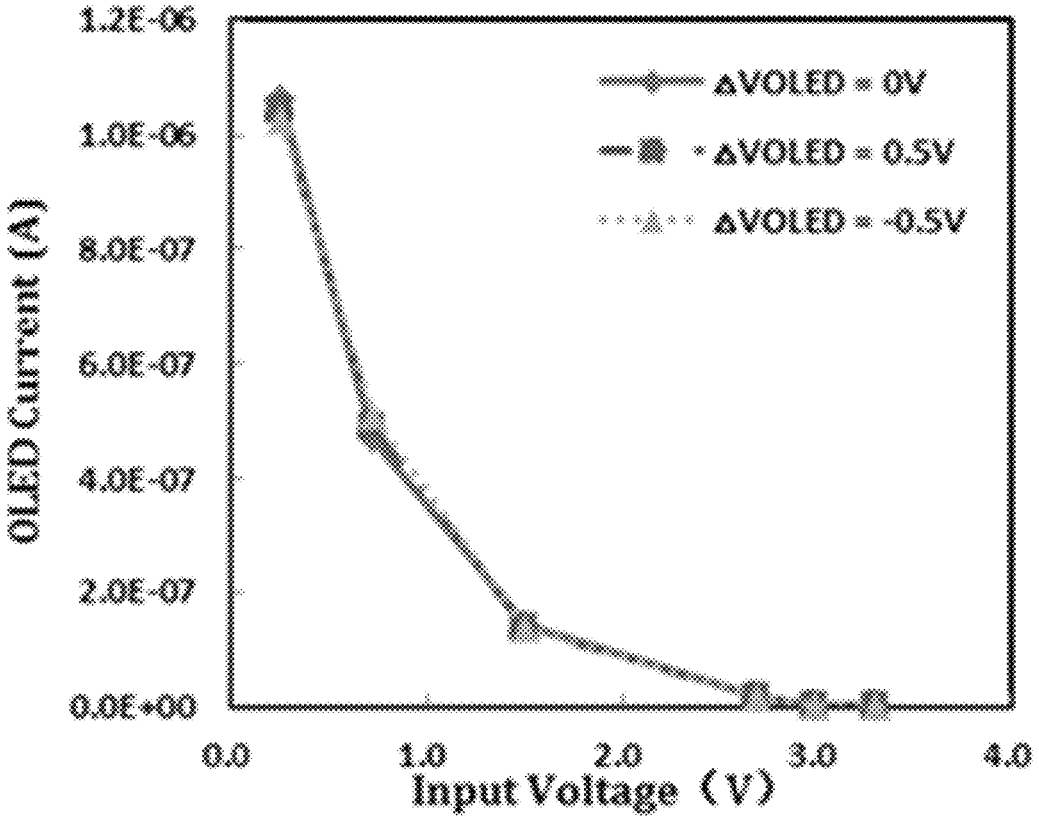
FIG. 9 is a simulation diagram of the corresponding current flowing through the OLED as the threshold voltage of the OLED in the present invention drifts.

Please refer to FIG. 9. As the threshold voltage of the organic light emitting diode OLED respectively drifts 0V, +0.5V, −0.5V, the change of the current flowing through the organic light emitting diode OLED will not exceed 15%, which effectively ensures the light emitting stability of the organic light emitting diode OLED to make the brightness of the AMOLED more even.

In conclusion, the AMOLED pixel driving circuit and the pixel driving method provided by the present invention utilize the 6T2C structure driving circuit to compensate the threshold voltage changes of the drive thin film transistor and the organic light emitting diode in each pixel and the time of the compensation period is adjustable without influencing the light emitting period of the organic light emitting diode, of which the threshold voltage changes of the drive thin film transistor and the organic light emitting diode can be effectively compensated to make the display brightness of the AMOLED more even and to raise the display quality.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An AMOLED pixel driving circuit, comprising:

a first thin film transistor, a second thin film transistor, a third thin film transistor, a fourth thin film transistor, a fifth thin film transistor, a sixth thin film transistor, a first capacitor, a second capacitor and an organic light emitting diode; the first thin film transistor is a drive thin film transistor, and the fifth thin film transistor is a switch thin film transistor, and the first capacitor is a coupling capacitor, and the second capacitor is a storage capacitor;

a gate of the fifth thin film transistor is electrically coupled to a scan signal, and a source is electrically coupled to a data signal, and a drain is electrically coupled to a first node;

a gate of the fourth thin film transistor is electrically coupled to a first control signal, and a source is electrically coupled to the first node, and a drain is electrically coupled to a second node;

a gate of the sixth thin film transistor is electrically coupled to a second control signal, and a source is electrically coupled to the second node, and a drain is electrically coupled to one end of the second capacitor and a reference voltage;

a gate of the third thin film transistor is electrically coupled to the first control signal, and a source is electrically coupled to a drain of the second thin film transistor and a drain of the first thin film transistor, and a drain is electrically coupled to a third node;

a gate of the second thin film transistor is electrically coupled to a third control signal, and a source is electrically coupled to a power source positive voltage, and a drain is electrically coupled to the source of the third thin film transistor and a drain of the first thin film transistor;

a gate of the first thin film transistor is electrically coupled to the third node, and the drain is electrically coupled to the drain of the second thin film transistor and the source of the third thin film transistor, and a source is electrically coupled to a fourth node;

one end of the first capacitor is electrically coupled to the second node, and the other end is electrically coupled to the third node;

the one end of the second capacitor is electrically coupled to the drain of the sixth thin film transistor, and the other end is electrically coupled to the first node;

an anode of the organic light emitting diode is electrically coupled to the fourth node, and a cathode is electrically coupled to a power source negative voltage;

wherein the first control signal, the second control signal and the third control signal are each supplied as a voltage level that is selectively one of a high voltage level and a low voltage level and the voltage levels of the first control signal, the second control signal, and the third control signal are combined with one another as groups that respectively correspond to a data signal writing stage, a whole compensation stage, a discharging stage and a light emitting stage, wherein in the data signal writing stage, the first control signal is the low voltage level, and the second control signal is the high voltage level, and the third control signal is the high voltage level;

in the whole compensation stage, the first control signal is the high voltage level, and the second control signal is the low voltage level, and the third control signal is the high voltage level;

in the discharging stage, the first control signal is the high voltage level, and the second control signal is the low voltage level, and the third control signal is the low voltage level; and in the light emitting stage, the first control signal is the low voltage level, and the second control signal is the high voltage level, and the third control signal is the high voltage level.

2. The AMOLED pixel driving circuit according to claim 1, wherein all of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

3. The AMOLED pixel driving circuit according to claim 1, wherein all of the first control signal, the second control signal and the third control signal are provided by an external sequence controller.

4. The AMOLED pixel driving circuit according to claim 1, wherein the scan signal is a pulse signal in the data signal writing stage, and is the low voltage level in any of the whole compensation stage, the discharging stage and the light emitting stage.

5. The AMOLED pixel driving circuit according to claim 1, wherein the reference voltage is a constant voltage.

6. An AMOLED pixel driving circuit, comprising:

a first thin film transistor, a second thin film transistor, a third thin film transistor, a fourth thin film transistor, a fifth thin film transistor, a sixth thin film transistor, a first capacitor, a second capacitor and an organic light emitting diode; the first thin film transistor is a drive thin film transistor, and the fifth thin film transistor is a switch thin film transistor, and the first capacitor is a coupling capacitor, and the second capacitor is a storage capacitor;

a gate of the fifth thin film transistor is electrically coupled to a scan signal, and a source is electrically coupled to a data signal, and a drain is electrically coupled to a first node;

a gate of the fourth thin film transistor is electrically coupled to a first control signal, and a source is electrically coupled to the first node, and a drain is electrically coupled to a second node;

a gate of the sixth thin film transistor is electrically coupled to a second control signal, and a source is electrically coupled to the second node, and a drain is electrically coupled to one end of the second capacitor and a reference voltage;

a gate of the third thin film transistor is electrically coupled to the first control signal, and a source is electrically coupled to a drain of the second thin film transistor and a drain of the first thin film transistor, and a drain is electrically coupled to a third node;

a gate of the second thin film transistor is electrically coupled to a third control signal, and a source is electrically coupled to a power source positive voltage, and a drain is electrically coupled to the source of the third thin film transistor and a drain of the first thin film transistor;

a gate of the first thin film transistor is electrically coupled to the third node, and the drain is electrically coupled to the drain of the second thin film transistor and the source of the third thin film transistor, and a source is electrically coupled to a fourth node;

one end of the first capacitor is electrically coupled to the second node, and the other end is electrically coupled to the third node;

the one end of the second capacitor is electrically coupled to the drain of the sixth thin film transistor, and the other end is electrically coupled to the first node;

an anode of the organic light emitting diode is electrically coupled to the fourth node, and a cathode is electrically coupled to a power source negative voltage;

wherein all of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors;

wherein all of the first control signal, the second control signal and the third control signal are provided by an external sequence controller;

wherein the first control signal, the second control signal and the third control signal are each provided as a voltage level that is selectively one of a high voltage level and a low voltage level and the voltage levels of the first control signal, the second control signal, and the third control signal are combined with one another as groups that respectively correspond to a data signal writing stage, a whole compensation stage, a discharging stage and a light emitting stage, wherein in the data signal writing stage, the first control signal is the low voltage level, and the second control signal is the high voltage level, and the third control signal is the high voltage level;

in the whole compensation stage, the first control signal is the high voltage level, and the second control signal is the low voltage level, and the third control signal is the high voltage level;

in the discharging stage, the first control signal is the high voltage level, and the second control signal is the low voltage level, and the third control signal is the low voltage level; and in the light emitting stage, the first control signal is the low voltage level, and the second control signal is the high voltage level, and the third control signal is the high voltage level.

7. The AMOLED pixel driving circuit according to claim 6, wherein the scan signal is a pulse signal in the data signal writing stage, and is the low voltage level in any of the whole compensation stage, the discharging stage and the light emitting stage.

8. The AMOLED pixel driving circuit according to claim 6, wherein the reference voltage is a constant voltage.

9. An AMOLED pixel driving method, comprising steps of:

step S1, providing an AMOLED pixel driving circuit;

the AMOLED pixel driving circuit comprises: a first thin film transistor, a second thin film transistor, a third thin film transistor, a fourth thin film transistor, a fifth thin film transistor, a sixth thin film transistor, a first capacitor, a second capacitor and an organic light emitting diode; the first thin film transistor is a drive thin film transistor, and the fifth thin film transistor is a switch thin film transistor, and the first capacitor is a coupling capacitor, and the second capacitor is a storage capacitor;

a gate of the fifth thin film transistor is electrically coupled to a scan signal, and a source is electrically coupled to a data signal, and a drain is electrically coupled to a first node;

a gate of the fourth thin film transistor is electrically coupled to a first control signal, and a source is electrically coupled to the first node, and a drain is electrically coupled to a second node;

a gate of the sixth thin film transistor is electrically coupled to a second control signal, and a source is electrically coupled to the second node, and a drain is electrically coupled to one end of the second capacitor and a reference voltage;

a gate of the third thin film transistor is electrically coupled to the first control signal, and a source is electrically coupled to a drain of the second thin film transistor and a drain of the first thin film transistor, and a drain is electrically coupled to a third node;

a gate of the second thin film transistor is electrically coupled to a third control signal, and a source is electrically coupled to a power source positive voltage, and a drain is electrically coupled to the source of the third thin film transistor and a drain of the first thin film transistor;

a gate of the first thin film transistor is electrically coupled to the third node, and the drain is electrically coupled to the drain of the second thin film transistor and the source of the third thin film transistor, and a source is electrically coupled to a fourth node;

one end of the first capacitor is electrically coupled to the second node, and the other end is electrically coupled to the third node;

the one end of the second capacitor is electrically coupled to the drain of the sixth thin film transistor, and the other end is electrically coupled to the first node;

an anode of the organic light emitting diode is electrically coupled to the fourth node, and a cathode is electrically coupled to a power source negative voltage;

step S2, entering a scan stage;

the first control signal provides low voltage level, and the second control signal provides high voltage level, and the third control signal provides high voltage level, and both the third, the fourth thin film transistors are deactivated; the scan signal is a pulse signal and a line by line scan is implemented, and the data signal is written into the first node line by line and stored in the second capacitor;

step S3, entering a whole compensation stage;

all of the scan signals are low voltage level, and the fifth thin film transistors in all pixels are deactivated; the first control signal provides high voltage level, and the second control signal provides low voltage level, and the third control signal provides high voltage level, and both the third, the fourth thin film transistors are activated, and the sixth thin film transistor is deactivated, and the data signal is written into the second node from the first node, and voltage level of the third node is pulled to be high voltage level by the power source positive voltage;

step S4, entering a discharging stage;

all of the scan signals remain to be low voltage level, and the fifth thin film transistors in all pixels are deactivated; the first control signal provides high voltage level, and the second control signal provides low voltage level, and the third control signal provides low voltage level, and both the second, the sixth thin film transistors are deactivated, and the third node is discharged to:

$$V_G = VSS + V_{th_T1} + V_{th_OLED}$$

wherein $V_G$ represents a voltage of the third node, and $V_{th_T1}$ represents a threshold voltage of the first thin film transistor, and $V_{th_OLED}$ represents a threshold voltage of the organic light emitting diode;

step S5, entering a light emitting stage;

all of the scan signals remain to be low voltage level, and the fifth thin film transistors in all pixels are deactivated; the first control signal provides low voltage level, and the second control signal provides high voltage level, and the third control signal provides high voltage level, and both the second, the sixth thin film transistors are deactivated, and the second node is written with the reference voltage;

the voltage of the third node, i.e. a gate voltage of the first thin film transistor is coupled by the first capacitor to:

$$V_G = VSS + V_{th_T1} + V_{th_OLED} + V_{ref} - V_{Data}$$

a voltage of the fourth node, i.e. a source voltage of the first thin film transistor is:

$$V_B = VSS + V_{th_OLED} + f(\text{Data})$$

wherein $V_G$ represents the voltage of the third node, i.e. the gate voltage of the first thin film transistor, and VSS represents the power source negative voltage, and $V_{th_T1}$ represents a threshold voltage of the first thin film transistor, and $V_{th_OLED}$ represents a threshold voltage of the organic light emitting diode, and $V_{ref}$ represents the reference voltage, and $V_{Data}$ represents the data signal voltage, and $V_B$ represents the voltage of the fourth node, i.e. the source voltage of the first thin film transistor, and f(Data) represents a function related to the data signal;

the organic light emitting diode emits light, and a current flowing through the organic light emitting diode is irrelevant with the threshold voltage of the first thin film transistor and the threshold voltage of the organic light emitting diode.

10. The AMOLED pixel driving method according to claim 9, wherein all of the first thin film transistor, the second thin film transistor, the third thin film transistor, the fourth thin film transistor, the fifth thin film transistor and the sixth thin film transistor are Low Temperature Poly-silicon thin film transistors, oxide semiconductor thin film transistors or amorphous silicon thin film transistors.

11. The AMOLED pixel driving method according to claim 9, wherein all of the first control signal, the second control signal and the third control signal are provided by an external sequence controller.

12. The AMOLED pixel driving method according to claim 9, wherein the reference voltage is a constant voltage.

* * * * *